United States Patent [19]

Berkowitz

[11] 3,973,617

[45] Aug. 10, 1976

[54] METHOD AND APPARATUS FOR COOLING DIECASTING MOLD

[75] Inventor: Murray Berkowitz, Woodcliff Lake, N.J.

[73] Assignee: Curtiss-Wright Corporation, Wood-Ridge, N.J.

[22] Filed: Apr. 28, 1975

[21] Appl. No.: 572,517

[52] U.S. Cl. ..... 164/113; 164/72; 164/121; 164/348; 165/80

[51] Int. Cl.[2] ..... B22D 17/22

[58] Field of Search ..... 164/113, 121, 348, 72, 164/158; 425/225; 165/80

[56] References Cited

UNITED STATES PATENTS

| | | | |
|---|---|---|---|
| 1,712,946 | 5/1929 | Williams | 164/348 X |
| 3,364,987 | 1/1968 | Bylund et al. | 165/80 |
| 3,595,301 | 7/1971 | Bauer | 164/113 |

*Primary Examiner*—Robert D. Baldwin
*Attorney, Agent, or Firm*—Arthur Frederick; Victor D. Behn

[57] ABSTRACT

Molding apparatus and method for producing die castings having high, closely spaced projections extending therefrom formed by mold portions which are re-entrant or interleaved between the projections of the casting. Such re-entrant mold portions do not cool rapidly between casting shots and their tips are liable to stick to the casting, making it difficult or impossible to release. The invention provides a die mold having such re-entrant portions and a method of rapidly cooling such portions between casting shots in order to provide acceptable production rates.

6 Claims, 7 Drawing Figures

FIG. 1
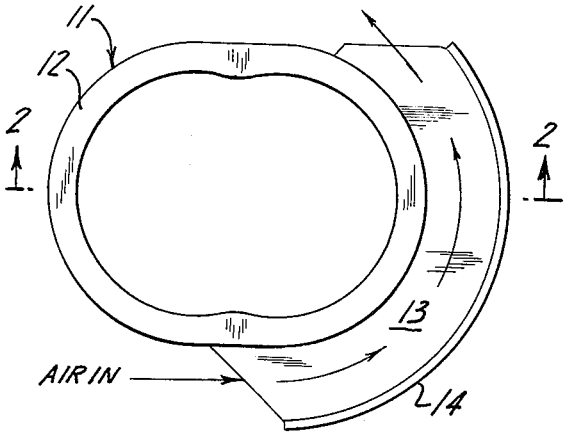
FIG. 5
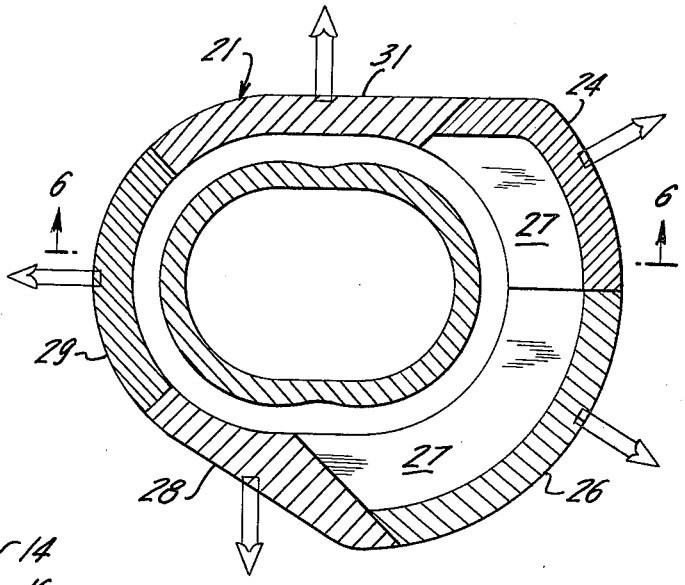
FIG. 2
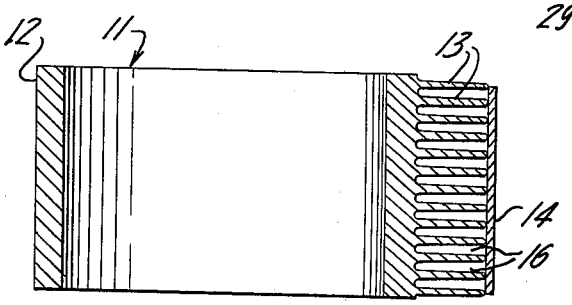
FIG. 6
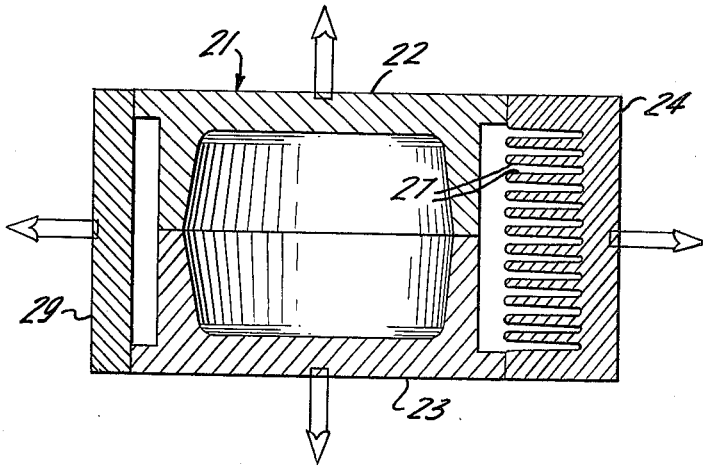
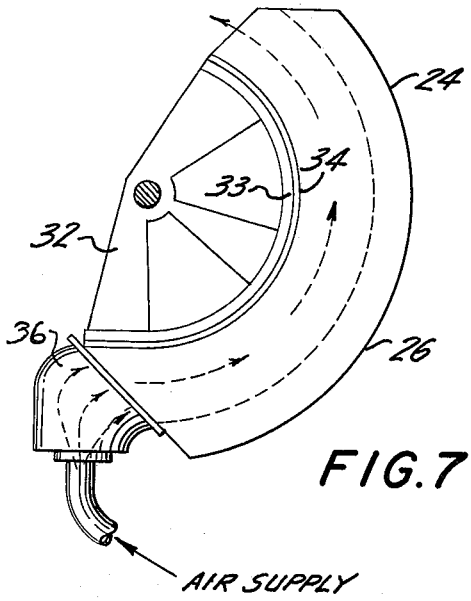
FIG. 7

METHOD AND APPARATUS FOR COOLING DIECASTING MOLD

BACKGROUND OF THE INVENTION

This invention relates to die casting equipment and methods, and more particularly to die casting molds for production castings having closely spaced projections thereon, such as finned objects for heat transfer, wherein the fins or other projections have limited space therebetween produced by re-entrant portions of the mold, and a method of cooling such re-entrant mold portions to prevent them from sticking to the casting.

Finned objects in the prior art have been produced by several means. Cylinders for air-cooled engines have been sand-cast with external fins, but such fins have been of large cross-section and spacing in relation to their height, and sand-casting is a slow and expensive process.

Finned tubes for heat exchangers are commonly made by sliding thin annuli over the tube and soldering or welding them in place. Finned tubes have also been made by helically winding a strip edgewise around the tube and welding or soldering the inner edge to the tube.

Finned objects have sometimes been made by die casting, but again the fins have been heavy and widely spaced, even with internal passages in the die for water cooling. In some cases the fin-forming portions of the die have been sprayed with water mist while the die is open between shots, or have had an air blast directed into them. A different approach is shown in U.S. Pat. No. 3,595,301 issued July 27, 1971 to Alfred F. Bauer. That patent discloses a method of making die-cast finned objects in which a die is assembled outside a casting machine, then loaded into the machine, the machine closed and a casting shot made, the machine opened and the die containing the cast object removed from the machine, the die disassembled to remove the casting therefrom, and the die parts then placed into a bath to bring them to proper temperature. This is a complex and cumbersome procedure, and if only one die is available the production rate is necessarily slow owing to the number of manual operations which have to be conducted outside the casting machine between shots. If a number of dies are provided to keep the machine busy the cost is correspondingly increased, and extra personnel are needed to carry out the manual operations. Even with the procedure disclosed in the patent, the fins produced by that method are of a height only about three times their thickness at the base.

The present invention overcomes these limitations of the prior art.

SUMMARY

This invention provides a method and apparatus for automatic die-casting of objects having a plurality of high, closely spaced projections thereon, such as fins, pins, or other projections of extended area for cooling the object in its subsequent utilization. Such projections are formed on the cast article by a die having projecting coring portions which are approximately the negative images of the projections on the casting and are re-entrant or interleaved therebetween. Such coring portions receive a great deal of heat during casting shots and do not give it up readily to the main mass of the die, owing to the long path of heat transfer. Therefore, the tips of such coring portions of the die are the hottest when the die is opened and the casting ejected, with the result that unless they can be effectively cooled before the next shot they may stick to the casting, making it difficult or impossible to eject and damaging the die.

The negative images of the coring portions of the die comprise in effect the same type of configuration as the cooling projections on the cast article, and hence can be used for cooling the die. After a casting shot the casting machine automatically opens the die and ejects the cast article. The parts of the die containing such coring portions are then automatically reclosed, a dummy shroud is positioned over the open side of the core portions to define passages therebetween, a nozzle positioned at one end of the passages, and a coolant discharged therethrough. In further automatic operation the dummy shroud and nozzle are then removed, the casting machine closed to fully reassemble the die, and another casting shot made. The invention allows the automatic die-casting of finned articles, for instance, in which the fins may project to a height more than 20 times their thickness at the base, with the spacing between fins approximately equal to fin thickness.

It is therefore an object of this invention to provide a method and apparatus for die-casting.

It is another object to provide a method and apparatus for automatic cooling of die-casting molds.

A further object is to provide a method and apparatus for die-casting articles having high projections of thin cross-section and small spacing therebetween.

Other objects and advantages will become apparent on reading the following specification in connection with the accompanying drawings.

BRIEF DESCRIPTION OF THE DRAWINGS

FIG. 1 shows semischematically a plan view of a die-cast finned article according to the invention;

FIG. 2 is a cross-sectional elevation taken on line 2—2 of FIG. 1;

FIG. 5 is a plan view in cross-section of an assembled die mold according to the invention;

FIG. 6 is a cross-sectional elevation taken on line 6—6 of FIG. 5; and FIG. 7 is a plan view of the die cooling means.

DESCRIPTION OF A PREFERRED EMBODIMENT

Figure 3:
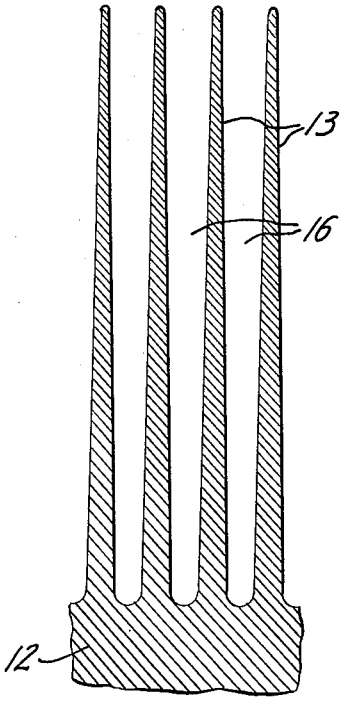
FIG. 3 is a fragmentary view in cross-section of a plurality of fins approximately in the proportion achievable with this invention.

Many products require that the surface have projections of extended area, for cooling or other purposes. In air cooled engines, for example, the horsepower output attainable is limited by the effectiveness of the cooling, and therefore closely spaced fins as high and as thin as possible are desired. The limitation on such fin parameters is the casting process, in speed of operation, control of dimensions, and life of the casting die.

Although this invention will be described principally in terms of a finned rotor housing for an air-cooled rotary combustion engine, it is to be understood that it applies also to die-casting any article having similar problems, and particularly to die-casting such articles as have projections of considerable extent thereon, especially when such projections have thin cross-sections and close spacing.

FIGS. 1 and 2 show a rotor housing 11 for a rotary engine, having a peripheral wall 12 with a plurality of fins extending from a portion of the circumference thereof and integral therewith. The outer tips of the fins are covered by a shroud member 14 which defines with the fins air passages 16 between the fins. In the assembled engine of which the housing 11 is a part, the region of highest heat input to the peripheral shell will be that region bearing the fins 13. In operation of the engine, cooling air is introduced into one end of passages 16, as shown in FIG. 1, and travels circumferentially through the passages in the direction of the arrows to discharge at the other end. Other combinations of entry and exit may, of course, occur when the fins are differently oriented, such as axially instead of circumferentially.

In the example of FIGS. 1 and 2, for convenience of illustration the fins shown are relatively low in height and moderately bulky in cross-section. However, for some uses it may be necessary to have fins of extreme height, thin section, and close spacing. In FIG. 3 there is shown a group of fins 13 and passages 16 in approximately such proportions as may be readily fabricated by the method and apparatus of this invention. The fins 13 shown in FIG. 3 project from the wall to a distance equal to about twenty-one times the thickness of the fins at the roots. The spacing between the fins at the root is approximately equal to the fin thickness at that portion.

Figure 4:
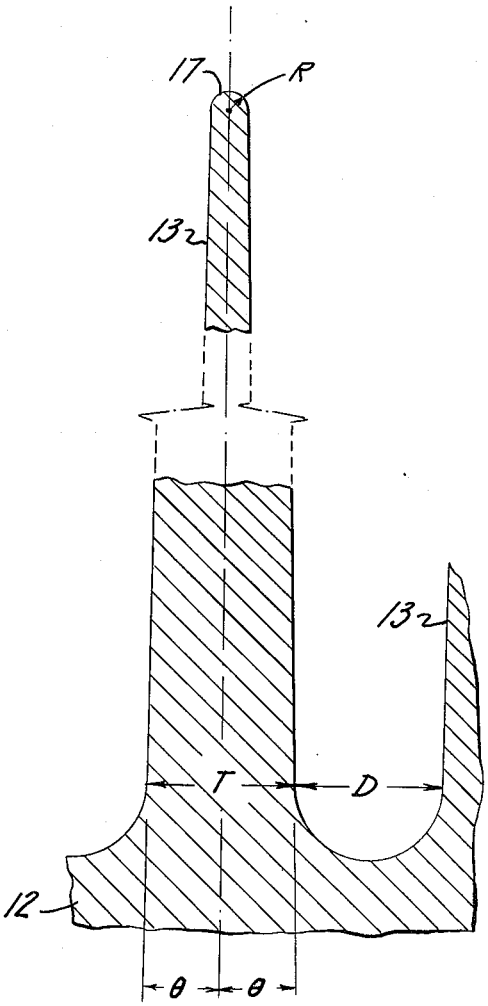
FIG. 4 is a schematic showing of a suitable fin design for fin dimensions and spacing formed by the apparatus and method of this invention.

This concept is better exemplified in the enlarged showing of FIG. 4, which illustrates suitable design criteria for a group of fins of extreme height. The radius R of the fin thickness at its tip 17 may be as small as about 0.025 inch. From the fin tip 17 each of the sides of the fin descends at an angle $\theta$ which may be as low as about 1° from the median plane of the fin. At the roots the fins are filleted into the shell wall 12. The distance D between adjacent fins at the point of tangency of the root fillets is made approximately equal to the thickness T of the fin at its base. The distance between the median planes of adjacent fins will therefore be twice either the thickness T or the spacing distance D. For any given spacing and fin thickness, the height of the fins from the surface of the cast article is determined by the tip radius R selected and the slope of angle $\theta$ selected. The dimensions here given for R and the slope of angle $\theta$ are subject to the usual manufacturing tolerances, but otherwise are believed to be approximately the smallest feasible with this invention for a high production rate of die-casting, and constitute an advance in the art. However, where the thinnest and highest feasible fins are not required, radius R and angle $\theta$ may have any larger values desired, with resulting variations in fin thickness, height, and spacing.

FIGS. 5 and 6 show in cross-section a die-casting mold 21 suitable for forming the die-cast article 11 shown in FIGS. 1 and 2. The mold 21 comprises a plurality of slides which are automatically movable in the casting machine along the directions shown by the broad arrows, meeting and parting along the planes indicated by the heavy lines in the drawings. When the mold 21 is closed and a casting shot is made, the top slide 22 and the bottom slide 23 form the hollow interior of the shell 11 and also the plane faces of the shell wall 12. Slides 24 and 26 are provided with internal fins 27 which form the external fins 13 on the die-cast article. The remaining slides 28, 29, and 31 serve to form the remainder of the housing shell.

It is to be understood that the mold shown and described is exemplary only and the slides need not be of exactly the number and form shown. For instance, slides 24 and 26 could be combined into a single slide movable along a line parallel to the long dimension of the shell. Slides 28 and 29 could be combined and movable at any suitable angle away from the shell, or slides 29 and 31 likewise could be combined and movable along another angle to the shell. However, in good casting practice it is ordinarily preferred not to have too large an area of a casting engaged by a single slide. This would be particularly true of slides 24 and 26, with their interleaving engagement with the fins of the casting, which might make release difficult.

Also, with a different arrangement and configuration of the slides and their opening directions, the invention is applicable to casting articles with fins or other projections differently oriented, such as axially rather than circumferentially, and the fins or other projections need not extend perpendicularly to the surface of the cast article.

The fins 27 of mold slides 24 and 26 form that portion of the cavity in which fins 13 of the housing 11 are cast, and are therefore negative images of fins 13. Although fins 27 are also shown in FIG. 6 as of relatively low height and thick cross-section for convenience of illustration, they will be designed to form the fins desired on the cast article, such as shown in FIGS. 3 and 4. Therefore, the root fillets of fins 27 will have radii appropriate to form the tips 17 of cast fins 13, and the tips of fins 27 will form the root fillets of cast fins 13.

It will be apparent that after a casting shot into the closed mold 21 to form article 11, a great deal of heat from the molten metal is transferred to the parts of the mold. It is necessary that the mold should be maintained cool enough to quickly freeze the metal of the cast article, and after release of the casting no portion of the mold should be allowed to retain enough heat to be near the melting temperature of the casting metal when the mold is closed for the next shot, or there will be sticking and soldering of the die parts to the casting and difficulty in releasing it.

The slides forming relatively uncomplicated portions of the casting will ordinarily lose enough heat while the mold is open, some to ambient air and some through heat transfer to the platens of the casting machine. However, this process cannot be relied on to cool deeply re-entrant portions of the mold, such as fins 27, which are more or less shielded from ambient air and which have a very long path for heat transfer to some other portion of the equipment. Prior art means of cooling such re-entrant die portions, such as merely waiting for the mold to cool or manually directing a coolant against it, have been slow and cumbersome, restricting production rates.

FIG. 7 shows the means provided by this invention for cooling critical die portions. After the die is opened and the cast article ejected, the die slides having deeply re-entrant portions, in this embodiment slides 24 and 26, are reclosed. A support element 32 bearing a dummy shroud 33 of appropriate configuration is automatically swung or translated into position so that the shroud 33 is pressed into contact with the tips of mold fins 27. The dummy shroud 33 may be formed of material having a high coefficient of heat transfer, such as copper or aluminum, to comprise a rapid heat sink for absorption of some of the heat from the fin tips, and may also bear a surface pad 34 of copper wool or aluminum wool to insure good contact with the fin tips. The shroud 33 may also be water-cooled during the period when casting is taking place in the closed mold.

The dummy shroud thus defines with fins 27 a plurality of passages therebetween, similar to those of the housing shell when in use. As the dummy shroud 33 moves into position, a nozzle 36 also moves into position at one end or the other of the passages thus defined. The nozzle is provided with a pressurized supply of coolant, such as air, or air loaded with water mist, which discharges from the nozzle through the passages and is emitted at the other end. Any such coolant used may also contain an admixture of any of the desired lubricants or mold releases which are commonly employed in die-casting.

The mold fins are thus cooled in much the same manner as the housing fins during operation of the engine, and at least as effectively. After the coolant blast the nozzle and the dummy shroud retract, the machine closes the remainder of the mold parts, and the next casting shot is made.

It will be seen that the present invention provides a method and apparatus for rapid automatic production of die castings of articles having extending therefrom projections of greater height, closer spacing, and thinner cross-section than has heretofore been achievable.

What is claimed is:

1. In an automatic diecasting machine having a mold comprising a plurality of mold parts movable to close the mold for a casting shot and movable to open the mold to release a cast article, the improvement comprising:

a. at least one of the mold parts having a plurality of inwardly projecting fin-like portions of extended area to form outwardly projecting cooling fins on the casting, b. a shroud member for positioning against the tip ends of the inwardly projecting fin-like portions of the mold part when the mold is open to define coolant passages with and between said projecting fin-like portions; and c. a nozzle having a coolant supply for positioning in communication with said passages to discharge coolant therethrough.

2. The combination recited in claim 1, wherein the shroud member is formed of a material having a high coefficient of heat transfer to absorb heat from the inwardly projecting mold portions.

3. The combination recited in claim 2, wherein the shroud member bears a facing pad of metal wool having a high coefficient of heat transfer, the facing pad being disposed to make contact with the inwardly projecting mold portions.

4. The combination recited in claim 1, wherein there are a plurality of adjacent mold parts each having a plurality of inwardly projecting, fin-like portions of extended area, and the said adjacent mold parts are re-assembled in casting contiguity before positioning the shroud member and the coolant nozzle.

5. A method of automatically diecasting an article having a plurality of outwardly projecting cooling fins of extended area on a surface thereof, comprising in combination the steps of closing a die mold having a plurality of movable parts, at least one of said movable parts having a plurality of inwardly projecting fin-like portions of extended area to form the outwardly projecting cooling fins on the casting, filling the mold with molten casting metal under pressure, opening the mold to discharge the casting by retracting the movable die parts from each other, positioning a shroud member against the tip ends of the inwardly projecting fin-like portions of the die part to define coolant passages in the die part between said fin-like projections, positioning a coolant nozzle in communication with the passages, and discharging a coolant therefrom through the passages to cool the inwardly projecting portions.

6. The method recited in claim 5, wherein there are a plurality of adjacent mold parts each having a plurality of said inwardly projecting fin-like portions, and the said adjacent mold parts are re-assembled in casting contiguity before positioning the shroud member and the coolant nozzle.

* * * * *